US007867157B2

(12) United States Patent
Beck et al.

(10) Patent No.: US 7,867,157 B2
(45) Date of Patent: Jan. 11, 2011

(54) FOLDING MACHINE WITH A ROTARY STAND

(75) Inventors: Christoph Beck, Spiegelberg (DE); Georg Dannemann, Backnang (DE); Martin Sailer, Murrhardt (DE); Eberhard Krieger, Weinstadt-Struempfelbach (DE)

(73) Assignee: Maschinenbau Oppenweiler Binder GmbH & Co. KG, Oppenweiler (DE)

( * ) Notice: Subject to any disclaimer, the term of this patent is extended or adjusted under 35 U.S.C. 154(b) by 0 days.

(21) Appl. No.: 11/594,980

(22) Filed: Nov. 9, 2006

(65) Prior Publication Data

US 2007/0105699 A1 May 10, 2007

(30) Foreign Application Priority Data

Nov. 9, 2005 (DE) ..... 10 2005 053 436

(51) Int. Cl.
*B31B 1/26* (2006.01)

(52) U.S. Cl. ..... 493/405; 493/417; 493/475; 493/478

(58) Field of Classification Search ..... 493/405, 493/417, 475, 478, 479
See application file for complete search history.

(56) References Cited

U.S. PATENT DOCUMENTS 3,475,018 A * 10/1969 Mattka ..... 493/274
3,513,743 A * 5/1970 Montguire ..... 83/433
4,900,002 A * 2/1990 Zechner ..... 270/45
5,056,294 A * 10/1991 Focke ..... 53/201
6,485,401 B2 * 11/2002 Gorrochategui ..... 483/1
7,083,563 B1 * 8/2006 Long ..... 493/429

FOREIGN PATENT DOCUMENTS

DE 14 36 596 A1 3/1969
DE 31 47 064 A1 6/1983
GB 206870 A 11/1923

OTHER PUBLICATIONS

Official Action from the European Patent Office, European Patent Application No. 06 021 354.3-2314, dated Mar. 23, 2009, 15 pages. Translation of claims to be granted by the European Patent Office.

* cited by examiner

*Primary Examiner*—Hemant M Desai
(74) *Attorney, Agent, or Firm*—Rothwell, Figg, Ernst & Manbeck, P.C.

(57) ABSTRACT

The folding machine has a cross fold module which includes a cross-fold folding blade (18), a sheet-supporting device (38) which is arranged below the cross-fold folding blade (18) and on which an incoming sheet comes to rest, and a roller frame (27) which is arranged below the sheet-supporting device (38) and into which a sheet is introduced by the cross-fold folding blade (18). A three-fold module (22) with a three-fold folding blade (24) arranged perpendicularly with respect to the cross-fold folding blade (18) is arranged downstream of the roller frame (27). The three-fold module (22) and the roller frame (27) are arranged on a rotary stand (20) which is rotatable through at least 180 about a vertical axis (28).

2 Claims, 2 Drawing Sheets

FOLDING MACHINE WITH A ROTARY STAND

BACKGROUND OF THE INVENTION

1. Field of the Invention

The invention relates to a folding machine comprising a cross-fold module having a cross-fold folding blade, a sheet-supporting device which is arranged below the cross-fold folding blade and on which an incoming sheet comes to rest, and a roller frame which is arranged below the sheet-supporting device and into which a sheet is introduced by the cross-fold folding blade, and a three-fold module which is arranged downstream of the roller frame and has a three-fold folding blade arranged perpendicularly with respect to the cross-fold folding blade.

2. Description of the Background Art

DE 31 47 064 A1 discloses a folding-device assembly which has a first basic module which has, successively in the sheet-running direction, a supply table for supplying sheets and a buckle folding device. Arranged downstream of the first basic module is a second basic module which comprises a cross fold module on the one side of which a three-fold module is arranged and on the other side of which a buckle folding device is arranged. This creates the possibility of supplying a sheet which has been folded in the cross fold module either to the three-fold module or to the buckle folding device for folding, the choice being undertaken as a function of the type of end product to be folded. By means of the three-fold module, the sheet is folded transversely with respect to the folding of the cross fold module while the folding buckle device forms a further folding parallel to the folding of the cross fold module.

The second basic module is designed as a moveable unit and has two opposite inputs with a conveying device, which can be switched over, for connection to the first basic module in positions offset by 180°. The flexibility of the folding device assembly can be increased by the second basic module. However, the conveying device which can be switched over is very complicated in terms of structure. In addition, the adaptation of the moveable second basic module to the first basic module is difficult, since the position has to be precisely positioned.

SUMMARY OF THE INVENTION

The invention is based on the object of providing a folding machine which can be adapted rapidly and simply to different types of fold.

This object is achieved by a folding machine comprising a cross-fold module having a cross-fold folding blade, a sheet-supporting device which is arranged below the cross-fold folding blade and on which an incoming sheet comes to rest, and a roller frame which is arranged below the sheet-supporting device and into which a sheet is introduced by the cross-fold folding blade, and a three-fold module which is arranged downstream of the roller frame and has a three-fold folding blade arranged perpendicularly with respect to the cross-fold folding blade, wherein the three-fold module and the roller frame are arranged on a rotary stand which is rotable through at least 180° about a vertical axis.

The design of the folding machine according to the invention makes it possible, depending on the desired type of fold, to arrange the three-fold module rapidly and simply on one of the two sides of the cross-fold folding blade. Since the cross-fold folding blade and the sheet-supporting device remain in a fixed position, if appropriate with a holding-down device and an end-stop device being included, it is merely required to rotate the roller frame and the three-fold module about the vertical axis of rotation.

The flexibility of the folding machine is further increased if on the rotary stand a folding buckle device is arranged, with respect to the axis of rotation, diametrically opposite the three-fold module. This creates the possibility of folding a sheet, which has been folded by the cross-fold folding blade, on both sides of the cross-fold folding blade both by means of a folding buckle device and by means of a three-fold module.

The rotation of the rotary stand is simplified if the cross-fold folding blade and the sheet-supporting device of the cross fold module are fitted on a frame which is mounted in a manner such that it can be pivoted upwards about a pivot axis. If the frame is pivoted upwards, the rotary stand together with the roller frame, the three-fold module and, if appropriate, the folding buckle device can be rotated freely about the axis of rotation.

BRIEF DESCRIPTION OF THE DRAWINGS

An exemplary embodiment of the invention is explained in more detail below with reference to the attached drawings, in which.

DETAILED DESCRIPTION OF THE INVENTION

Figure 1:
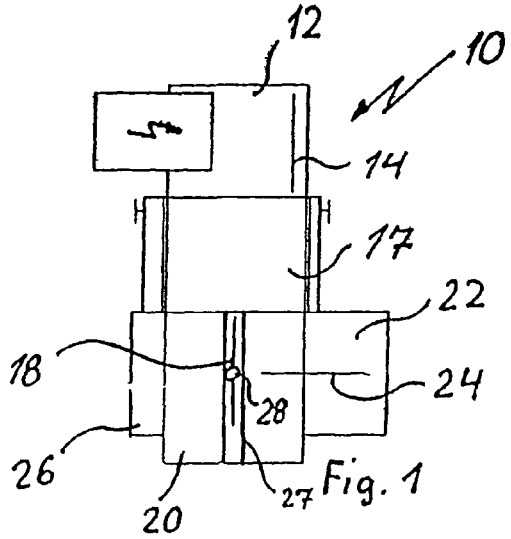
FIG. 1 shows a schematic plan view of a folding machine with a rotary stand in a first basic position.
Figure 2:
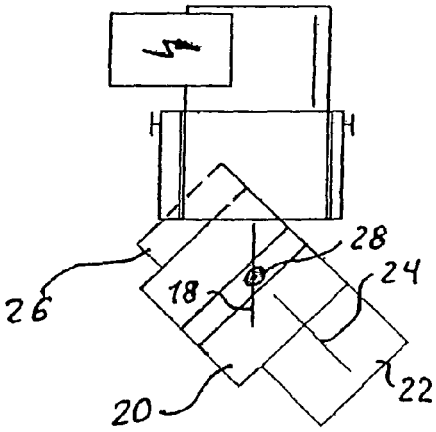
FIG. 2 shows a plan view of the folding machine of FIG. 1, with the rotary stand in a 45° rotational position.
Figure 3:
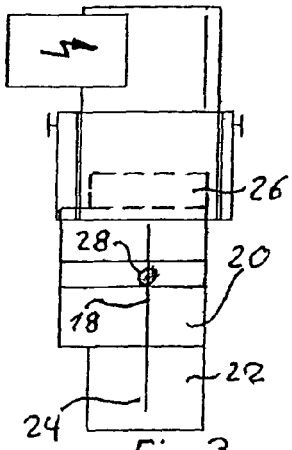
FIG. 3 shows a plan view of the folding machine of FIG. 1, with the rotary stand in a 90° rotational position.
Figure 4:
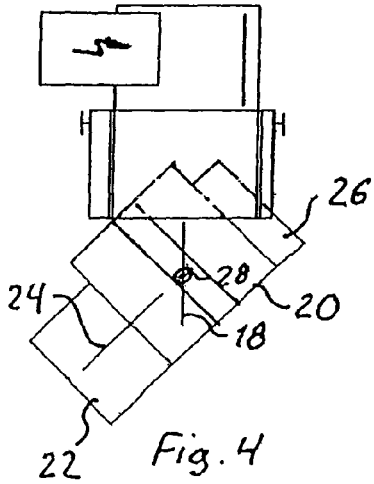
FIG. 4 shows a plan view of the folding machine of FIG. 1, with the rotary stand in 135° rotational position.

The folding machine shown in FIGS. 1 to 6 comprises an aligning table 12 with a sloping conveying belt and a stop strap 14 which extends in the sheet running direction by means of which a sheet conveyed by the sloping conveyor belt is aligned in the sheet running direction before it is introduced into a buckle folding device 17 which is arranged downstream of the aligning table 12. Arranged downstream of the buckle folding device 17 in the sheet running direction is a cross fold module 19 which comprises a cross-fold folding blade 18 which is arranged above a sheet-supporting device 38 (FIG. 6) which is preferably formed by a plurality of endless transporting belts arranged in parallel at a distance from one another. In addition, the cross fold module can have a holding-down device for holding down an incoming sheet and an end stop device against which an incoming sheet comes to bear with its leading edge.

Figure 6:
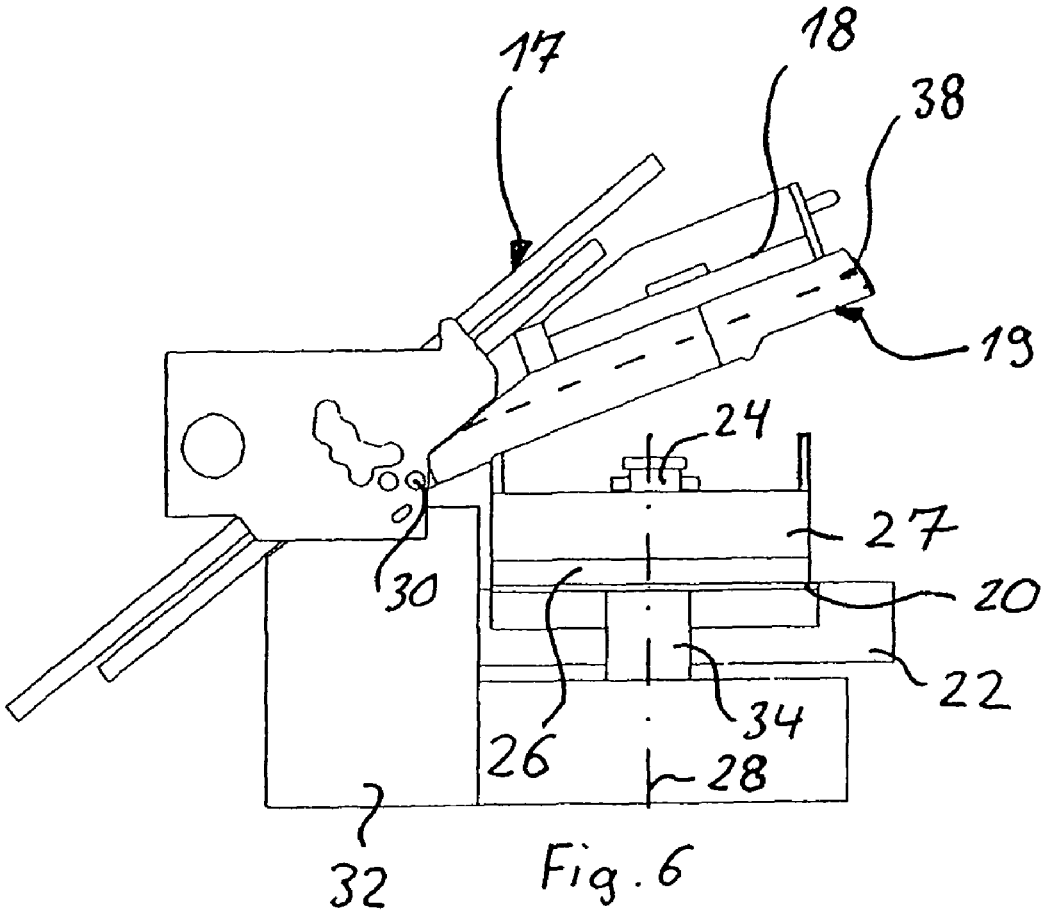
FIG. 6 shows a side view of the folding machine of FIG. 5 with the cross-fold frame swung up.

As can be seen in FIG. 6, the cross-fold folding blade 18 and the sheet-supporting device 38 and, if appropriate, the holding-down device and the end stop device are fitted on a frame 19 which is mounted on the side facing the buckle folding device 17 in a manner such that it can pivot about a pivot axis 30 on the machine stand 32 of the folding machine 10. In addition, part of the cross fold module 19 is a roller frame 27 which is fitted on a rotary stand 20 below the sheet-supporting device 38 and therefore cannot be pivoted together with the frame 19.

The rotary stand 20 arranged below the frame 19 comprises a rotary pillar 34 which is rotatable about a vertical axis 28 on the machine stand 32.

FIG. 1 shows the folding machine 10 in a first basic position in which the roller frame 27 is arranged below the cross-fold folding blade 18, so that a sheet coming from the buckle folding device 17 can be introduced by the cross-fold folding blade into a first pair of folding rollers (not shown) of the roller frame 20. It can also be seen in FIG. 1 that, on the right side with respect to the cross-fold folding blade 18, a three-fold module 22 is arranged fixedly on the rotary stand 20, the said three-fold module having a three-fold folding blade 24 which runs perpendicularly with respect to the cross-fold folding blade 18. If the roller frame 27 is set to a first setting, a sheet which has been folded by the cross-fold folding blade 18 is supplied to the three-fold module 22, and the three-fold folding blade 24 carries out a folding which runs perpendicularly with respect to the folding which has been implemented by the cross-fold folding blade 18.

Diametrically opposite the three-fold module 22, with respect to the axis of rotation 28, a folding buckle 26 is fitted on the rotary stand 20 parallel to the cross-fold folding blade 18. The roller frame 27 can be set in a second setting in such a manner that a sheet introduced into the roller frame 27 by the cross-fold folding blade 18 is supplied to the folding buckle 26 which then carries out a folding which runs parallel to the folding by the cross-fold folding blade 18.

Figure 5:
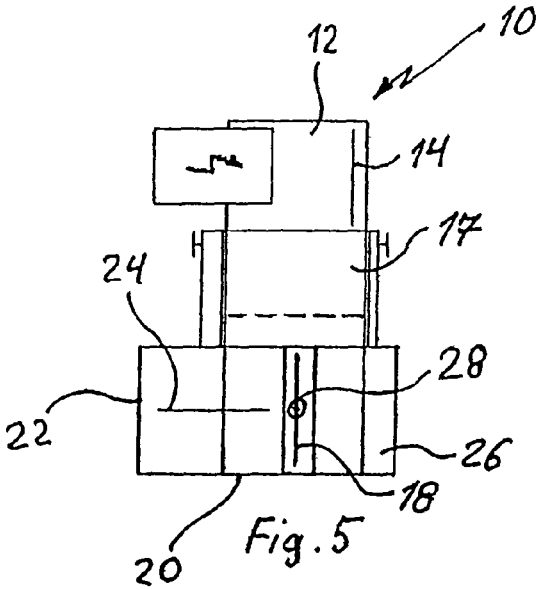
FIG. 5 shows a plan view of the folding machine of FIG. 1, with the rotary stand in a second basic position.

Depending on the type of finished folding product, it may be required to arrange the three-fold module 22 on the left side and the folding buckle 26 on the right side, as shown in FIG. 5. This can be brought about in a simple manner by the frame 19 being folded upwards (FIG. 6), so that the rotary stand 20 with the three-fold module 22, the folding buckle 26 and the roller frame 27 is released, and the rotary stand 20 is pivoted through 180° about the axis of rotation 28, as shown FIGS. 2 to 5. The frame 19 is subsequently folded back into its original position and the new folding operation can be carried out.

The invention claimed is:

1. A folding machine comprising a machine stand, a cross-fold module having a cross-fold folding blade, a sheet-supporting device arranged below said cross-fold folding blade and on which an incoming sheet comes to rest, and a roller frame arranged below said sheet-supporting device and into which a sheet is introduced by said cross-fold folding blade, and a three-fold module arranged downstream of said roller frame of said cross-fold module and having a three-fold folding blade arranged perpendicularly with respect to said cross-fold folding blade, said cross-fold folding blade and said sheet-supporting device of said cross-fold module being fitted on a cross-fold frame which is pivotally mounted to said machine stand in a manner such that said cross-fold frame pivots upwards about a horizontal pivot axis on said machine stand together with said cross-fold folding blade and said sheet-supporting device, said three-fold module and said roller frame of said cross-fold module being arranged on a rotary stand arranged below said cross-fold frame and comprising a rotary pillar being rotatable through at least 180° about a vertical axis on said machine stand when said cross-fold frame is pivoted upwards, the roller frame of the cross-fold module not being pivoted together with said cross-fold frame.

2. Folding machine according to claim 1, wherein on said rotary stand a folding buckle is arranged, with respect to said vertical axis of rotation, diametrically opposite said three-fold module.

* * * * *